US010760153B2

(12) United States Patent
Martin et al.

(10) Patent No.: US 10,760,153 B2
(45) Date of Patent: Sep. 1, 2020

(54) METHOD FOR MANUFACTURING TURBOMACHINE COMPONENTS, BLANK AND FINAL COMPONENT

(71) Applicant: Safran Aircraft Engines, Paris (FR)

(72) Inventors: Guillaume Martin, Moissy-Cramayel (FR); Céline Jeanne Marcillaud, Moissy-Cramayel (FR); Marie Mineur-Panigeon, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 186 days.

(21) Appl. No.: 15/557,400

(22) PCT Filed: Mar. 4, 2016

(86) PCT No.: PCT/FR2016/050507

§ 371 (c)(1),
(2) Date: Sep. 11, 2017

(87) PCT Pub. No.: WO2016/142611

PCT Pub. Date: Sep. 15, 2016

(65) Prior Publication Data

US 2018/0112300 A1 Apr. 26, 2018

(30) Foreign Application Priority Data

Mar. 12, 2015 (FR) ..... 15 52055

(51) Int. Cl.
*C22F 1/18* (2006.01)
*C22C 14/00* (2006.01)
(Continued)

(52) U.S. Cl.
CPC ..... *C22F 1/183* (2013.01); *B21D 22/022* (2013.01); *B22D 7/005* (2013.01); *B22D 11/003* (2013.01);
(Continued)

(58) Field of Classification Search
CPC ..... C22F 1/183; C22F 1/04; B22D 11/003; B22D 11/10; B22D 7/005; C22C 14/00
See application file for complete search history.

(56) References Cited

U.S. PATENT DOCUMENTS 5,609,698 A * 3/1997 Kelly ..... C22F 1/183 148/670
2006/0230876 A1* 10/2006 Blum ..... B22D 7/00 75/10.18

(Continued)

FOREIGN PATENT DOCUMENTS

WO WO 01/62992 A1 8/2001
WO WO 2011/104795 A1 9/2011
WO WO 2014/057208 A2 4/2014

OTHER PUBLICATIONS

Kim et al.; "Method to Produce Gamma Titanium Aluminide Articles having Improved Properties"; Sep. 4, 2001; United States; Statutory Invention Registration; Reg. No. US H1988 H (Year: 2001).*

*Primary Examiner* — Lee A Holly
(74) *Attorney, Agent, or Firm* — Blank Rome LLP

(57) ABSTRACT

The manufacture of a metal turbomachine part, comprising steps consisting of melting a titanium-aluminium intermetallic compound by plasma torch in a ring mould, extracting therefrom an ingot, as cast, in a state cooled from molten, cutting the ingot into at least one blank with an external shape that is simpler than the more complex one of said part to be manufactured, and machining the blank in order to obtain the part with said more complex external shape.

24 Claims, 2 Drawing Sheets

Figure 1:
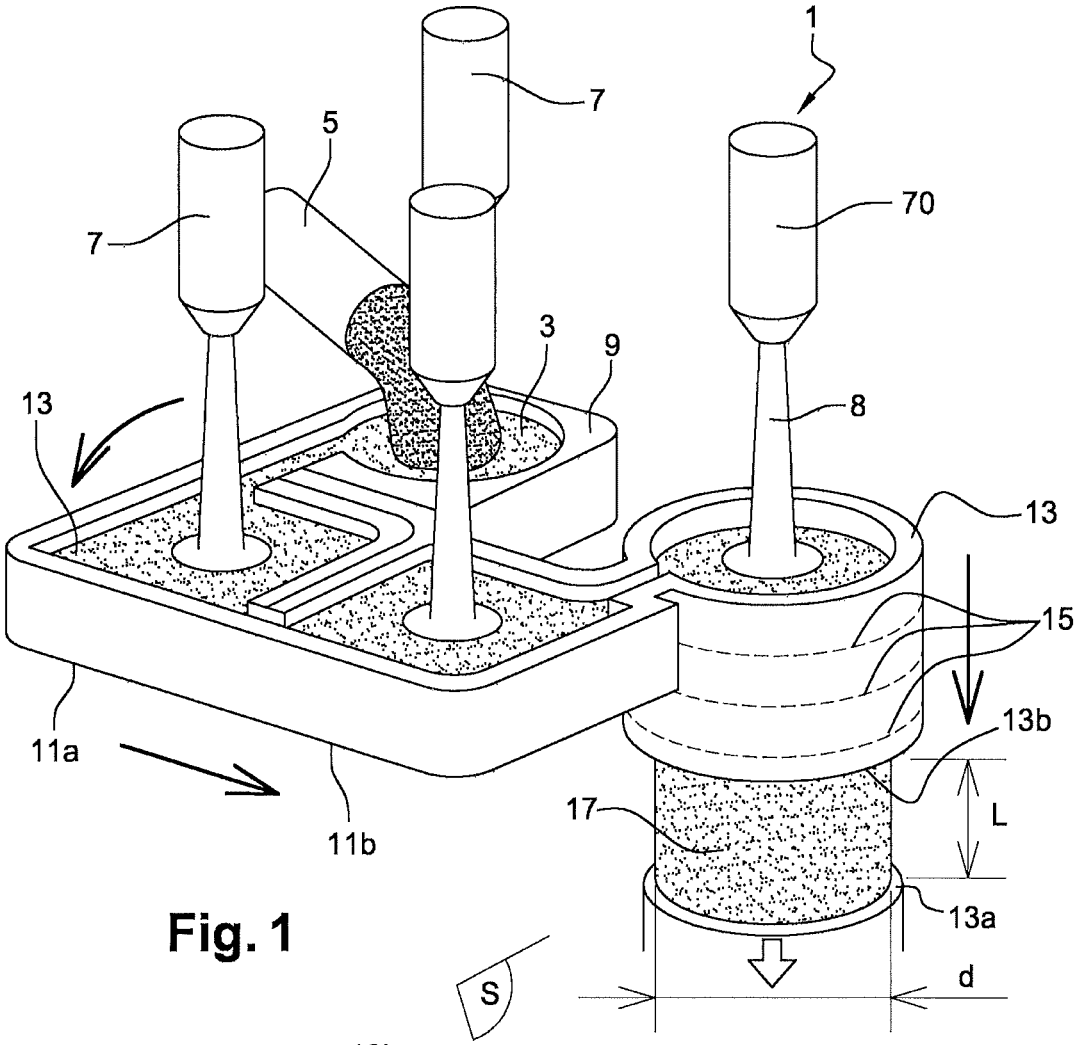

(51) Int. Cl.

| | |
|---|---|
| ***B22D 27/04*** | (2006.01) |
| ***B22D 11/10*** | (2006.01) |
| ***B22D 11/00*** | (2006.01) |
| ***B21D 22/02*** | (2006.01) |
| ***B22D 7/00*** | (2006.01) |

(52) U.S. Cl.
CPC ..... *B22D 11/10* (2013.01); *B22D 27/045* (2013.01); *C22C 14/00* (2013.01)

(56) References Cited

U.S. PATENT DOCUMENTS

| | | | | |
|---|---|---|---|---|
| 2010/0163592 | A1* | 7/2010 | DeClark | B23D 31/002 225/2 |
| 2015/0231746 | A1* | 8/2015 | Marcillaud | F01D 5/147 29/889.7 |
| 2016/0186578 | A1* | 6/2016 | Suciu | F01D 5/28 416/241 R |

* cited by examiner

METHOD FOR MANUFACTURING TURBOMACHINE COMPONENTS, BLANK AND FINAL COMPONENT

This application is a national phase of PCT/fr2016/050507, filed on Mar. 4, 2016 which claims priority to FR1552055 filed Mar. 12, 2015. The content of those applications are hereby incorporated by reference.

The present invention relates to a method for manufacturing metal turbomachine parts, and in particular movable turbine wheel blades of an aircraft turbojet engine or turboprop engine.

It relates to a titanium-aluminium intermetallic compound alloy. TiAl 48-2-2 is specifically concerned.

It also relates to an assembly comprising a blank for a turbomachine part made from such an alloy based on TiAl and a machined part resulting from the machining of this blank.

An alloy forms an intermetallic compound with certain chemical compositions and under certain pressure and temperature conditions. Unlike a conventional alloy, where atoms of different natures may be distributed randomly on the same crystallographic site, an intermetallic compound consists of a periodic alternation of atoms. Thus, when an elementary mesh is looked at, a crystalline structure can be noticed.

The formation by founding (casting) of a part made from titanium-aluminium intermetallic alloy is extremely difficult at the present time and does not make it possible to cast sufficiently fine thicknesses to produce, by founding (casting), parts with finished cast regions.

Managing to efficiently machine a part made by founding (casting) is furthermore difficult.

Two categories of problems result therefrom:

those related to the founding (casting), those related to the machining, the whole to be considered in an economic context.

In the prior art, there exist in particular the following solutions:

1) a solution providing for the obtaining of an over-thick rough form by lost-wax founding (casting), and then machining this rough form in order to obtain the final part, such as a blade, 2) a solution consisting of the casting of a blank to the almost final form of the part (referred to as "near net shape"), next allowing machining that is certainly minimal (with little loss of material) of the final part, but which remains necessary, 3) and a solution by founding (casting) in a centrifuged permanent mould, where it is possible to make provision for manufacturing a plurality of turbomachine parts, following steps consisting of:

a) pouring the metal material into a centrifuged casting mould, b) extracting therefrom a blank of elongate shape, preferably substantially cylindrical or polyhedral and/or with a circular or polygonal cross section, and c) machining the blank until the final form of the part is obtained.

Solutions by forging also exist, but are tricky to implement because of the fragility of TiAl alloys.

One drawback of founding (casting) for parts based on TiAl is the very rapid solidification of the molten material.

The result of this is a high risk of porosity of the parts, a failure to achieve suitable filling of the moulds and therefore a tricky finalisation of the external form of the as-cast rough form (blank).

Furthermore, a hot isostatic compression (HIC) is next typically necessary in order to close up any porosities, implying significant cost. In addition, this treatment is not always sufficient, in particular if the porosities of the rough form are opening out.

As drawbacks of loss-wax founding (casting) (non-permanent mould), the following can be noted:

the necessary use of rare materials for the mould shell (such as yttrium), with costs and supply problems, the risk of weakening of the parts via the formation of inclusions: both those issuing from the mould/shell reactivity (specific to TiAl since it is very reactive) and those issuing from shell debris that fall into the moulds (specific to the lost-wax process), the very specific development of the shell, with typically a compromise to be found between resistance to centrifugation force and the friability of the shell for facilitating removal from the mould, the use of specific installations for casting by centrifugation.

Other points may also be mentioned:

Drawbacks of solution 1): during the heat treatment consisting of hot isostatic compression (HIC) that this solution requires, residual stresses are stored in the part. Unpredictable deformations are too often discovered on machining.

Drawbacks of solution 2): sufficient excess thickness of material is not available on the as cast rough form (the blank) in order to avoid a lack of material on the finished part if the blank is slightly deformed and it is sought to machine this part in an automated manner. A risk of non-compliance with the dimensions of the finished part also exists.

Drawbacks of solution 3): a lengthy implementation before ending up (in particular if it is a case of a blade) with an optimised mould+part system leading neither to shrinkages of excessive size, nor to a chemical and macrostructural heterogeneity of the blank due to solidification.

One objective of the invention is to avoid or limit many of the problems mentioned above.

One solution for this is a method for manufacturing at least one metal turbomachine part, comprising steps consisting of:

a) keeping a TiAl (titanium-aluminium) intermetallic alloy melted by plasma torch in a retractable-bottom mould (or ring mould), b) extracting therefrom an ingot, as cast, in a state cooled from molten, c) cutting the ingot into at least one blank with an external shape that is simpler than the more complex one of the part to be manufactured, d) and machining the blank in order to obtain the part with said more complex external shape.

The term "blank" must be understood here in a fairly broad sense. It designates a product that is not finished but the general form of which corresponds essentially to the appearance of the finished part. This means that a blank for a part as aforementioned is a metal product of the aforementioned type. This excludes neither the subsequent adaptation of the shape of this blank, for example by machining, nor the modification of this general appearance, for example by curving, bending or any other plastic deformation. It must rather be understood that a "blank" of a product of the aforementioned type is a part of this type that may undergo various shaping, machining or surface treatments in order to give rise to a finished product.

To supplement the aforementioned solution, it is advised that:

at step c), the cut blank, from which the part of step d) is to be machined, should have a given external volume and/or mass A1, at step d), the machined part should have a given external volume and/or mass A2, and the ratio A2/A1 should be greater than 0.95.

One objective sought is a machining aimed at reduced losses of material. In this context, and in a more general context of saving on material, it is moreover recommended that:

at step c), all the cut blanks should represent more than 95% of the external volume and/or of the mass of the ingot extracted, and/or at step b), a substantially cylindrical or polyhedral ingot should be obtained.

Typically, the "ring moulds" mentioned above are referred to as PAM (plasma arc melting) furnaces. These PAM furnaces are normally, in the prior art, used for casting material for remelting, that is to say, after melting of the material in the PAM furnace, this material solidifies, and is then remelted in order be cast. The cast bars, or ingots, then have very large diameters (especially >200 mm).

However, in order to comply with the requirements of a rough PAM bar or ingot, to be used with a view to direct machining, it has appeared useful to change the PAM method in order to make it more robust and better in a position to produce ingots without defects.

In this light, it is here proposed to cast PAM ingots of smaller diameters where the phenomena giving rise to defects are more easily controllable.

Thus it is in practice advised that, at step b), the extracted ingot should have a diameter of less than or equal to 200 mm or a cross section of less than approximately $32\times10^3$ $mm^2$ within 5%.

Applying the aforementioned PAM production in particular to such small diameters of ingots will make it possible to avoid the shrinkage and chemical segregations that are the two main technical difficulties in casting in a centrifuged permanent mould, with solidification that will take place sequentially in a small volume that will be referred to as solidification wells.

By using such a PAM method, it will therefore be possible to obtain semifinished products with very little porosity and very homogeneous.

Moreover, by proceeding with a heat treatment in one of more operations, as advised below, the obtaining of the desired microstructure and mechanical properties will be encouraged even further.

This treatment, applied a priori to the blank, will favourably comprise:

a heat treatment to obtain a duplex microstructure consisting of gamma grains and lamellar grains (alpha2/gamma), and/or a heat treatment for preparation for HIC (hot isostatic compacting) and then HIC (in order to close up the porosities).

As an alternative or in addition, it is however provided for the post-PAM treatment, on a blank consisting of a TiAl alloy with gamma grains having typically a composition containing between approximately (to within 5%) 47 and 49 percent aluminium (at %), to be as follows:

heat treatment by heating to a temperature of approximately (within 5%) 1038° C. to 1149° C., for a period of approximately 5 to approximately 50 hours, the material next optionally undergoing hot isostatic compression (HIC) at a temperature of between 1185° C. and 1204° C., then another heat treatment at a temperature of between approximately 1018° C. and 1204° C. (still within 5%), without HIC.

If the melting step and the step of obtaining the ingot are properly carried out it could be unnecessary to apply pressure during the second aforementioned heat treatment step.

In the above global context, it is anticipated that the ranges comprising the manufacture of bars or ingots with a view to direct machining, after cutting into a blank or blanks of simple shape during step c), must be designed so as to comply with the requirements of the final parts since they are in this case directly transferred onto the blanks. The main requirements are:

chemical homogeneity, which guarantees microstructural and mechanical homogeneity after heat treatment, absence of inclusion or non-molten part (portion of the original material not melted in the PAM furnace), few porosities on the as-cast bars/ingots and with sizes less than one millimetre, practically no porosity on the blank, after HIC (if this compression takes place).

Concerning the assembly already mentioned including:

a blank of a turbomachine part made from a TiAl intermetallic compound, obtained at the end of melting by plasma torch, and a machined part issuing from the machining of such a blank, provision is made for the blank to have a determined external volume and/or mass A1, and the machined part having a determined external volume and/or mass A2, the ratio A2/A1 being greater than 0.95 and less than 1.

In correlation with the above, this assembly will favourably be such that the blank will have a diameter of less than or equal to 200 mm, preferably 120 mm, and a length of less than 300 mm, preferably between 220 mm and 240 mm.

This will assist a saving on material, particular in the context of the manufacture of a blade.

Before the aforementioned step a) of keeping the alloy molten, it will be possible to provide a series of plasma torches to melt the intermetallic compound and to keep it molten.

Figure 2:
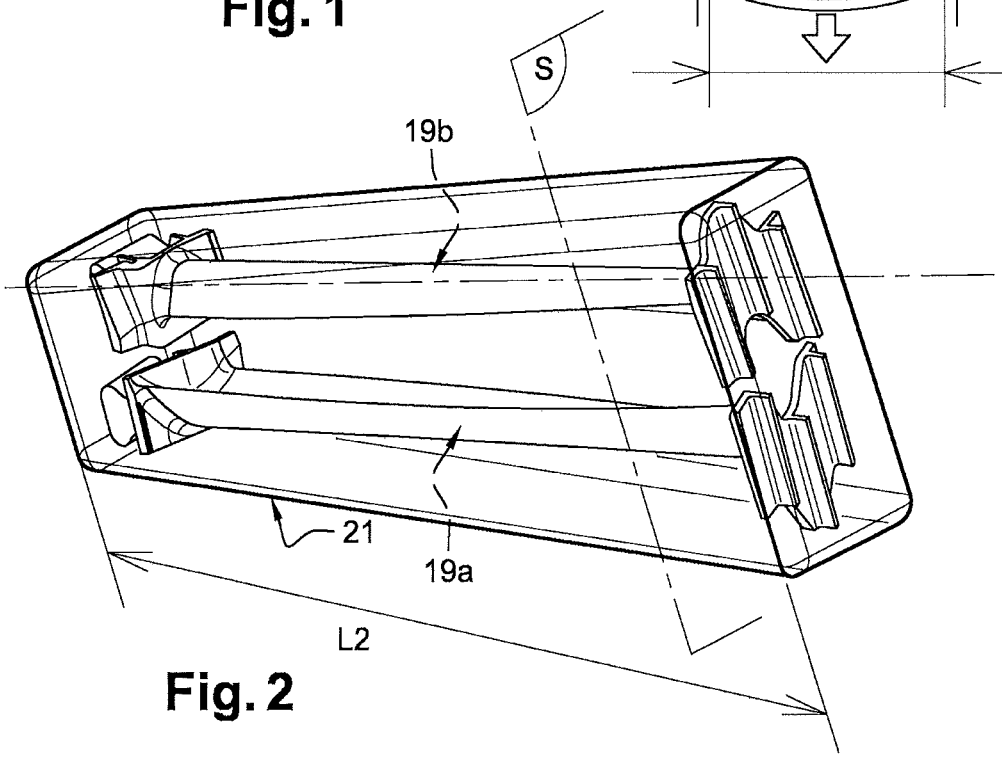
Figure 3:
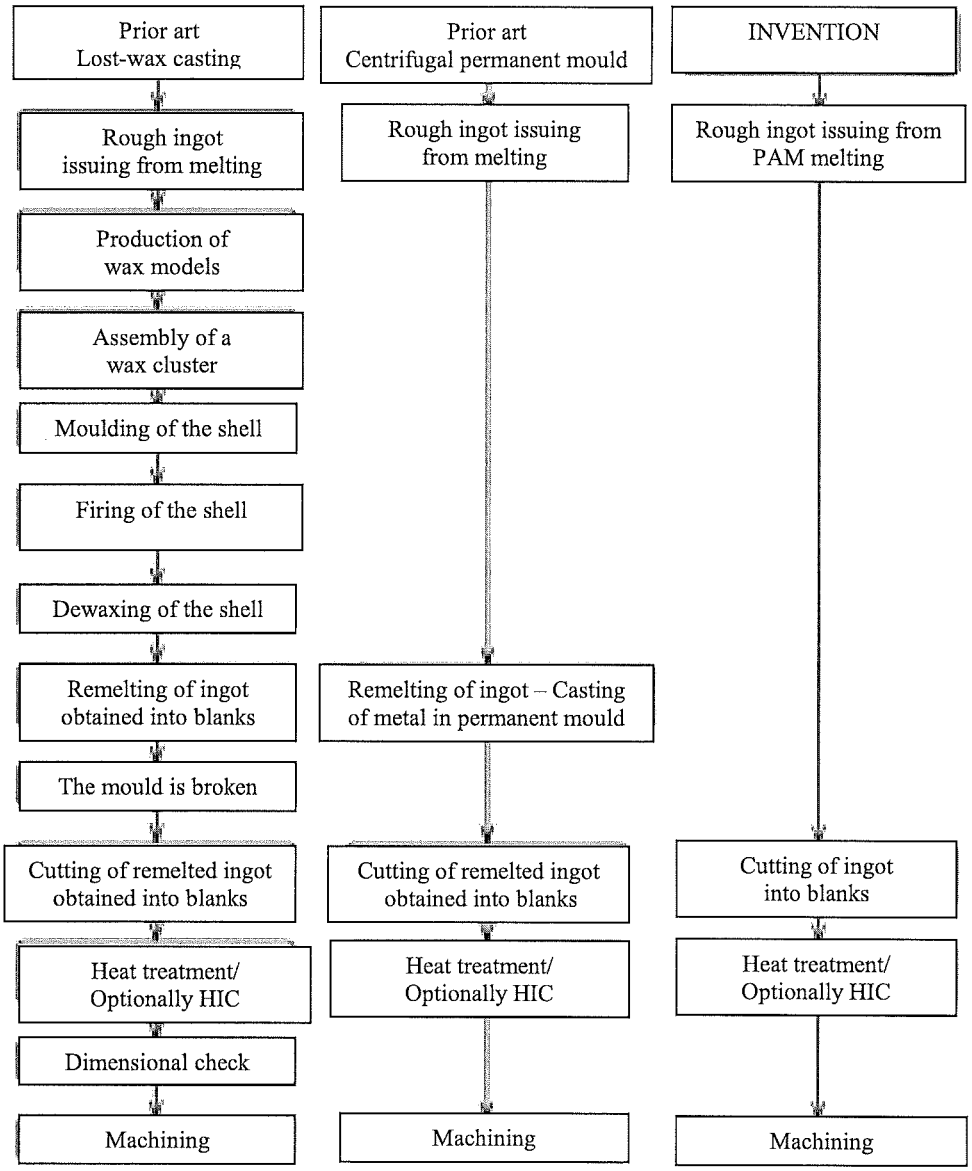

Other advantages and features of the invention will also emerge from a reading of the following description given by way of non-limitative example and with reference to the accompanying drawings, where FIGS. 1 and 2 are dimensionally precise and correspond to industrial reality, like dimensioned drawings, and in which:

FIG. 1 shows schematically a PAM fusion furnace from which an ingot is extracted, FIG. 2 is a schematic view in perspective of a block of material, or blank, issuing from a rough cut of the ingot extracted, and FIG. 3 is a table that presents and compares these cases of manufacture of a metal part in accordance with those mentioned above, intended for a turbomachine, in particular a movable turbine wheel blade of an aircraft turbojet engine or turboprop engine.

In the left-hand column in FIG. 3, the steps are listed involving remelting, with lost-wax moulding (temporary mould), of a rough ingot issuing from melting (other than PAM), at the initial step.

In the central column the steps also involving remelting are listed, with moulding in a centrifuged mould (permanent mould), of a rough ingot issuing from melting (other than PAM), at the initial step.

And in the right-hand column the steps of the present invention are listed without moulding or necessarily remelting, after a rough ingot issuing from PAM melting has been obtained at the initial step.

Thus:

in the "lost-wax casting" prior art, the following steps are successively carried out: obtaining a rough ingot issuing from melting, and then production of wax models, then assembly of a wax cluster, then moulding of the shell, then firing the shell, then dewaxing of the shell, then remelting of the ingot—casting of the metal, then the mould is broken, then cutting the remelted ingot obtained into blanks, then heat/optionally HIC treatment, then dimensional check and machining;

in the "centrifugal permanent mould" prior art, the following steps are successively carried out: obtaining a rough ingot resulting from melting, then remelting an ingot—casting the metal in a permanent mould, then cutting the remelted ingot obtained into a blank, and then HIC heat treatment and machining;

the "invention" prior art, the following steps are successively carried out:

obtaining a rough ingot resulting from PAM melting, then cutting the remelted ingot obtained into a blank, and then heat treatment/optionally HIC and machining.

The solution in the favoured example in the right-hand column therefore consists of limiting the manufacture of this part to four steps making provision for:

a) initially casting a TiAl intermetallic compound in a ring mould (or PAM furnace), with melting by plasma torch, b) extracting therefrom an as-cast ingot, in a state cooled from molten, c) cutting the ingot into at least one blank with a simpler external shape than the more complex one of said part to be manufactured, d) machining the blank in order to obtain the part with said more complex external shape.

As shown schematically in FIG. 1, the PAM melting 1 is here carried out with a material 3 that is TiAl, in this case 48-2-2 TiAl, therefore comprising 48% AI 2% Cr 2% Nb, at %). This raw material is introduced by means of a wide channel 5 where the material is poured, as shown in FIG. 1. A series of plasma torches 7 melt the metal provided and then keep it molten. There is at least one such torch above each vessel or receptacle 9 and refining hearth 11*a* and then 11*b*, with its beam such as 8 directed towards the metal in the vessel or hearth. The circulation (see arrows) of the metal bath is done from vessel to vessel. The flow of the material and the stirring of the liquid make it possible to prevent problems of segregation and the presence of any inclusion of heavy metals (high density inclusion—HDI), these problems being well known in the conventional technology of a VAR (vacuum arc remelting) remelting arc furnace. It is thus possible to consider a single melting, whereas by the VAR method two or even three successive meltings (referred to as remeltings) are necessary. The PAM technique also makes it possible to limit the appearance of alpha-phase inclusions (hard phase inclusion—HPI).

A last plasma torch 70, placed above a final mould or vessel, keeps the top of the bath arriving from the tanks 11*a* and then 11*b* molten therein. This final vessel is in the form a ring mould 13. The ring mould 13 comprises a bottom 13*a* that is retractable or movable, for example axially, here with controlled vertical movement. The ring mould 13 is cold, typically cooled from outside, for example with water, via cooling means 15. Under its bottom opening 13*b* and here by lowering of the movable bottom 13*a*, the bottom of the bath flows, by gravity or other, then sufficiently cold to form an ingot 17, as cast, in this state cooled from molten. The ring mould 13 may be made from copper.

By using the various vessels 9, multiple refining hearths, such as here 11*a*, 11*b*, and then the ring mould 13, with plasma torches 7, 70 also multiple and placed above each of these receptacles, the travel of the material will be optimised, so as to completely melt it and to keep it therein at a substantially homogenous temperature. Reducing the number of inclusions or non-molten parts will also be possible by using, as illustrated, a plurality of overflow tanks. To guarantee an even greater quality, it will also be possible to make provision for carrying out successive meltings of the material.

Typically, the ingot 17 obtained will be substantially cylindrical or polyhedral.

In order to assist compliance with the requirements of a bar or ingot 17 intended for direct machining, and therefore with neither any intermediate moulding nor the conventional drawbacks of lost-wax founding (casting) (defects resulting from interactions with the mould, which is typically made from ceramic), or other defects characteristic of producing by casting in centrifugal permanent moulds (central shrinkage and chemical macrosegregation, in particular), it is here proposed to cast ingots of small sizes, in particular such that each ingot 17 extracted has a transverse dimension d (diameter or width for a square cross section) less than or equal to 200 mm, and preferably 120 mm, or, in cross section, less than approximately $32\times10^3$ mm$^2$ and $12\times10^3$ mm$^2$ within 5%, respectively.

It is next from such an as-cast ingot that one and preferably a plurality of blanks 21 will be directly cut (by basic tools), each with a simple shape, in particular once again substantially cylindrical or polyhedral and in any case with an external shape simpler than the more complex one of each of said parts to be manufactured, the result of the machining of each blank, such as the two blades 19*a*, 19*b* that can be seen by transparency in the blank 21 of FIG. 2, aiming at a maximum use of the material.

This objective and a search for optimisation of the manufacturing processes in particular of turbine blades, with shortening of the cycle times, has moreover led to preferring:

that each blank 21 issuing from the ingot 17 should have a length L2 of less than 300 m, preferably between 220 mm and 240 mm, and a cross section S (perpendicular to its length L2) of less than $12\times10^3$ mm$^2$ within 5% (that is to say 1.2 dm$^2$), that at step c) all the cut blanks 21 represent more than 95% of the external volume and/or of the mass of the ingot 17 extracted, and/or:

that at step c) the cut blank 21; that is to say therefore the block from which the part of step d) (blade such as 19*a* or 19*b*) is to be machined, should have a determined external volume and/or mass, referred to as A1, that at this step d) the machined part 19*a* or 19*b* should have a given external volume and/or mass, referred to as A2, and that the ratio A2/A1 is greater than 0.95 and less than 1.

From a reading of the above table it will moreover have been clear that, between the step of cutting the ingot into blanks and the machining of each blank, preferably heat treatment (in a single sequence or multiple sequences) of each of these blanks will occur.

As already indicated, one aim will be to thereby assist the achieving of the expected mechanical and microstructure criteria.)

In fact, it is recommended carrying out:

a heat treatment so that the material of the blank has a duplex microstructure consisting of gamma grains and lamellar grains (alpha2/gamma), and/or heat treatment for preparation for HIC (hot isostatic compacting) and the HIC (to close the porosities again).

One aim being therefore to obtain a duplex microstructure (intermetallic compound) consisting of gamma grains and lamellar grains (alpha2/gamma), and it is in practice advised to proceed as follows (with values supplied within 5%):

a TiAl alloy with gamma grains, in particular the aforementioned one issuing from the PAM furnace 1, typically having a composition containing between approximately 47 and 49 percent aluminium (at %), undergoes heat treatment at a temperature from approximately 1035° C. to approximately 1150° C., for a period of approximately 5 to approximately 50 hours, then it undergoes another heat treatment at a temperature of between approximately 1000° C. and 1220° C.

Between the two steps of this heat treatment, the material will also have been able to undergo hot isostatic compression (HIC) at a temperature of approximately 1200° C., preferably between 1185° C. and 1204° C.

The invention claimed is:

1. A method for manufacturing a plurality of elongated metal turbomachine parts, the method comprising:

a) completely melting a titanium-aluminium intermetallic alloy, by plasma torch, and keeping it at a homogeneous temperature, then keeping the titanium-aluminium intermetallic alloy molten by plasma torch, in a ring mould, b) extracting from the ring mould an ingot, as cast, in a state cooled from molten, c) cutting the ingot into at least one blank, d) performing at least one of:

dl) heat treating the at least one blank to obtain a duplex microstructure consisting of gamma grains and lamellar grains (alpha2/gamma), and d2) heat treating the at least one blank to prepare the at least one blank for a hot isostatic compacting and then carrying out such a hot isostatic compacting, and e) machining the at least one blank in order to obtain, from said at least one blank, said plurality of elongated metal turbomachine parts, wherein the plurality of elongated metal turbomachine parts are disposed parallel with respect to each other.

2. The method of claim 1, wherein said step d) includes performing said steps dl) and d2) so that a TiAl alloy with gamma grains having a composition containing between approximately 47 and 49 percent aluminium (at %) undergoes, at said step d2):

said heat treatment by heating to a temperature of approximately 1038° C. to 1149° C., for a period of approximately 5 to 50 hours, then said hot isostatic compacting (HIC) at a temperature of between 1185° C. and 1204° C.

3. The method of claim 2, wherein said hot isostatic compacting of step d2) is followed by another heat treatment at a temperature of between approximately 1018° C. and 1204° C.

4. The method of claim 1, wherein:

the cut blank produced in step c) has a given external volume A1, each elongated turbomachine part produced in step e) has a given external volume A2, and A2/A1 is greater than 0.95.

5. The method of claim 1, wherein the at least one cut blank produced at step c) represents more than 95% of at least one of the external volume and the mass of the extracted ingot.

6. The method of claim 1, wherein step b) of obtaining an ingot comprises the obtaining of a cylindrical or polyhedral ingot.

7. The method of claim 1, wherein, at step b), the extracted ingot has a diameter of less than or equal to 200 mm, or a cross section of less than approximately $32\times10^3$ $mm^2$.

8. The method of claim 1, wherein the titanium-aluminium intermetallic alloy comprises 48% Al 2% Cr 2% Nb (at %).

9. The method of claim 1, wherein:

said step d) includes performing said step d1) so that said titanium-aluminium intermetallic alloy has the gamma grains and a composition containing between approximately 47 and 49 percent aluminium (at %), and heat treating the at least one blank includes:

- performing a first heat treatment by heating the at least one blank to a temperature of approximately 1038° C. to 1149° C., for a period of approximately 5 to 50 hours, and
- performing a second heat treatment by heating the at least one blank to a temperature of between approximately 1018° C. and 1204° C., without hot isostatic compression.

10. The method of claim 1, wherein:

the cut blank produced in step c) has a given mass Al, each elongated turbomachine part produced in step e) has a given mass A2, and A2/A1 is greater than 0.95.

11. The method of claim 1, wherein at step a) the titanium-aluminium alloy is completely melted in various vessels and refining hearths above each of which are disposed at least one of multiple plasma torches.

12. The method of claim 1, wherein at step a) a succession of complete meltings of the titanium-aluminium alloy is carried out.

13. The method of claim 1, wherein the at least one blank cut from the ingot at step c) has a length (L2) of less than 300 mm.

14. The method of claim 1, wherein the at least one blank cut from the ingot at step c) has a length (L2) between 220 mm and 240 mm.

15. The method of claim 1, wherein the ingot extracted at step b) has a diameter of less than or equal to 200 mm, or a cross section of less than approximately $32\times10^3$ $mm^2$ and the at least one blank cut from the ingot at step c) has a length (L2) of less than 300 mm.

16. A method for manufacturing at least one metal turbomachine part, the method comprising:

a) completely melting a titanium-aluminium intermetallic alloy, by plasma torch, and keeping it at a homogeneous temperature, then keeping the titanium-aluminium intermetallic alloy molten, by plasma torch, in a ring mould, b) extracting from the ring mould an ingot, as cast, in a state cooled from molten, c) cutting the ingot into at least one blank, d) performing at least one of:

dl) heat treating the titanium-aluminium intermetallic alloy to obtain a duplex microstructure consisting of gamma grains and lamellar grains (alpha2/gamma), and d2) heat treating the titanium-aluminium intermetallic alloy to prepare the titanium-aluminium alloy for a hot isostatic compacting and then carrying out such a hot isostatic compacting, and e) machining the at least one blank in order to obtain, from said at least one blank, said at least one metal turbomachine part.

17. The method of claim 16, wherein at step a) the titanium-aluminium alloy is completely melted in various vessels and refining hearths above each of which are disposed at least one of multiple plasma torches.

18. The method of claim 16, wherein at step a) a succession of sftid-complete meltings of the titanium-aluminium alloy is carried out.

19. The method of claim 16, wherein the at least one blank cut from the ingot at step c) has a length (L2) of less than 300 mm.

20. The method of claim 16, wherein the at least one blank cut from the ingot at step c) has a length (L2) between 220 mm and 240 mm.

21. The method of claim 16, wherein the ingot extracted at step b) has a diameter of less than or equal to 200 mm, or a cross section of less than approximately $32\times10^3$ $mm^2$ and the at least one blank cut from the ingot at step c) has a length (L2) of less than 300 mm.

22. The method of claim 16, wherein:

the cut blank produced in step c) has a given external volume A1, each elongated turbomachine part produced in step e) has a given external volume A2, and A2/A1 is greater than 0.95.

23. The method of claim 16, wherein:

the cut blank produced in step c) has a given mass Al, each elongated turbomachine part produced in step e) has a given mass A2, and A2/A1 is greater than 0.95.

24. A method for manufacturing at least one metal turbomachine part, comprising steps:

a) melting a titanium-aluminium intermetallic alloy and keeping it at a homogeneous temperature by means of multiple plasma torches, then keeping the titanium-aluminium intermetallic alloy molten by plasma torch in a ring mould, b) extracting from the ring mould an ingot, as cast, in a state cooled from molten, c) cutting the ingot into at least one blank having a length of less than 300 mm, d) performing at least one of:

dl) heat treating the titanium-aluminium intermetallic alloy to obtain a duplex microstructure consisting of gamma grains and lamellar grains (alpha2/gamma), and d2) heat treating the titanium-aluminium intermetallic alloy to prepare the titanium-aluminium intermetallic alloy for a hot isostatic compacting and then carrying out such a hot isostatic compacting, and e) machining the at least one blank in order to obtain, from said at least one blank, said at least one metal turbomachine part.

* * * * *